US005293945A

United States Patent [19]

Rosenhauch et al.

[11] Patent Number: 5,293,945

[45] Date of Patent: Mar. 15, 1994

[54] DOWNHOLE ADJUSTABLE STABILIZER

[75] Inventors: Irwin Rosenhauch, Kingwood, Tex.; Laurier E. Comeau, Alberta, Canada

[73] Assignee: Baroid Technology, Inc., Houston, Tex.

[21] Appl. No.: 808,028

[22] Filed: Dec. 13, 1991

Related U.S. Application Data

[63] Continuation of Ser. No. 800,441, Nov. 27, 1991.

[51] Int. Cl.[5] ..... E21B 17/10; E21B 7/08

[52] U.S. Cl. ..... 175/325.2; 175/73

[58] Field of Search ..... 175/325.1, 325.2, 73, 175/76, 61, 325.4

[56] References Cited

U.S. PATENT DOCUMENTS

| | | | |
|---|---|---|---|
| 2,891,769 | 6/1959 | Page, Sr. et al. | 175/76 |
| 3,298,449 | 1/1967 | Bachman et al. | 175/76 |
| 3,424,256 | 1/1969 | Jeter et al. | 175/76 |
| 3,627,356 | 12/1971 | Anderson | 285/118 |
| 3,974,886 | 8/1976 | Blake, Jr. | 175/76 |
| 4,185,704 | 1/1980 | Nixon, Jr. | 175/76 |
| 4,270,619 | 6/1981 | Base | 174/61 |
| 4,388,974 | 6/1983 | Jones, Jr. et al. | 175/325.2 |
| 4,394,881 | 0/0000 | Shirley | 175/76 |
| 4,407,377 | 10/1983 | Russell | 175/325 |
| 4,471,843 | 9/1984 | Jones, Jr. et al. | 175/73 |
| 4,491,187 | 1/1985 | Russell | 175/325 |
| 4,572,305 | 2/1986 | Swietlik | 175/325 |
| 4,754,821 | 7/1988 | Swietlik | 175/325 |
| 4,821,817 | 4/1989 | Cendre | 175/269 |
| 4,842,083 | 6/1989 | Raney | 175/325.4 |
| 4,844,178 | 7/1989 | Cendre et al. | 175/73 |
| 4,848,488 | 7/1989 | Cendre | 175/61 |
| 4,848,490 | 7/1989 | Anderson | 175/323 |
| 4,854,403 | 8/1989 | Ostertag et al. | 175/325.4 |
| 4,951,760 | 8/1990 | Cendre et al. | 175/269 |

FOREIGN PATENT DOCUMENTS

| | | | |
|---|---|---|---|
| 646129 | 8/1962 | Canada | 175/73 |
| 0409446 | 1/1991 | European Pat. Off. . | |
| 2016952 | 10/1971 | Fed. Rep. of Germany | 175/73 |
| WO91/08370 | 6/1991 | PCT Int'l Appl. . | |
| 541012 | 12/1976 | U.S.S.R. | 175/73 |
| 2230288 | 10/1990 | United Kingdom | 175/76 |

*Primary Examiner*—Hoang C. Dang

*Attorney, Agent, or Firm*—Browning, Bushman, Anderson & Brookhart

[57] ABSTRACT

A downhole adjustable stabilizer and method are disclosed for use in a well bore and along a drill string having a bit at the lower end thereof. A plurality of stabilizer blades are radially movable with respect to the stabilizer body, with outward movement of each stabilizer blade being in response to a radially movable piston positioned inwardly of a corresponding blade and subject to the pressure differential between the interior of the stabilizer and the well bore. A locking member is axially movable from an unlocked position to a locked position, such that the stabilizer blades may be locked in either their retracted or expanded positions. In the preferred embodiment of the invention, the stabilizer may be sequenced from a blade expanded position to a blade retracted position by turning on and off a mud pump at the surface. The stabilizer position may be detected by monitoring the back pressure of the mud at the surface, since the axial position of the locking sleeve preferably alters the flow restriction at the lower end of the stabilizer. High radially outward forces may be exerted on each stabilizer blade by one or more radially movable pistons responsive to the differential pressure across the stabilizer, and the stabilizer is highly reliable and has few force-transmitting components.

20 Claims, 6 Drawing Sheets

DOWNHOLE ADJUSTABLE STABILIZER

This application is a continuation of U.S. Ser. No. 07/800,441 filed on Nov. 27, 1991.

FIELD OF THE INVENTION

The present invention relates to a variable diameter stabilizer suitable for use within a drill string of a hydrocarbon recovery operation. More particularly, this invention relates to a drill string stabilizer wherein the stabilizer blade diameter may be reliably adjusted by operator surface sequencing techniques while the stabilizer remains downhole, and without requiring surface-to-stabilizer wireline operations. The adjustable stabilizer and technique of the present invention are applicable to varying well conditions to enhance stabilizer flexibility, and comparatively high radial forces may be applied to the stabilizer blades without complex mechanical force-multiplying devices.

BACKGROUND OF THE INVENTION

Those skilled in the art of drilling hydrocarbon recovery wells have long recognized the benefits of downhole stabilizers placed at strategic locations within the drill string. Numerous advances have been made to the design, material construction, and operation of stabilizers which have enhanced drilling operations, and thereby lowered hydrocarbon recovery costs. While drill string stabilizers have utility in borehole operations which are not related to hydrocarbon recovery, their primary purpose relates to use in hydrocarbon recovery wells, and accordingly that use is described herein.

One significant technological feature of downhole stabilizer relates to its ability to adjust the stabilizer diameter while the stabilizer is downhole by radially moving the stabilizer blades with respect to a fixed diameter stabilizer body. While blades in a stabilizer system have historically been "changed out" at the surface to increase or decrease the stabilizer diameter, this operation is time-consuming and thus expensive. The desirable downhole adjustment feature of a stabilizer has significant benefits with respect to selectively altering the drilling trajectory, particularly for stabilizers positioned close to the drill bit. By selectively increasing or decreasing the stabilizer diameter while downhole, drilling operators are better able to accommodate oversized holes or holes very close to gage. The drill string may be more easily tripped in and tripped out of a well bore by reducing the stabilizer diameter during this phase compared to the stabilizer's maximum diameter used in drilling operations, thereby saving substantial time and drilling costs. While wireline retrievable tools may be used for adjusting the stabilizer diameter while the stabilizer is downhole, the preferred technique for adjusting stabilizer diameter utilizes operations controlled at the surface, such as mud pump activation and weight-on-bit, to regulate this change in diameter.

One type of downhole stabilizer relies on alterations in weight-on-bit to adjust the stabilizer diameter. U.S. Pat. No. 4,572,305 to Swietlik discloses a stabilizer wherein its radial diameter is controlled by regulating the magnitude of force applied to the bit through the stabilizer. By increasing or decreasing the weight-on-bit, telescoping members affect the axial length of the stabilizer which causes cam followers to move along a cam surface to radially expand or retract stabilizer fins or blades. U.S. Pat. No. 4,754,821 discloses an improvement to this adjustable downhole stabilizer, wherein a locking device is employed to lock the stabilizer diameter, so that the axial force applied to the bit may be altered without changing the stabilizer diameter. A collar is moved to compress a spring and close a valve, which isolates hydraulic lines and locks the telescoping shafts into position.

U.S. Pat. No. 4,848,490 to Anderson discloses a downhole adjustable stabilizer, wherein a mandrel telescopes within a stabilizer casing and has cam surfaces which engage radial spacers. The stabilizer diameter is controlled by adjusting the weight-on-bit, and this control is functionally independent of hydraulic forces due to the pumping of drilling mud. A mechanical detent mechanism releases the mandrel to change the stabilizer diameter only when mechanical force above a critical value is obtained. European Patent Application 90307273.4 discloses a locking device for an adjustable stabilizer. The tool actuator is moveable by a substantial change in the fluid flow rate from a locking position to an unlocking position. The effective diameter of a downhole orifice changes between the locked and unlocked positions, and consequently a position determination can be obtained by monitoring fluid pressure at the surface.

U.S. Pat. No. 4,821,817 assigned to SMF International discloses a comparatively complicated actuator which utilizes drilling mud rather than weight-on-bit to control tool actuations. Fluid flow rate is used to regulate axial movement of a piston within the stabilizer. Stabilizer blades are moved radially in response to axial movement of a piston, with diameter changes occurring as a result of finger movement along successive inclined slopes arranged over the periphery of the piston. This toggle-type movement provides an indirect determination of the stabilizer diameter, since relative movement from any one finger level to another, which alters the cross-sectional flow passage through a port and thereby changes the head pressure at the surface, is ideally detected at the surfaces. U.S. Pat. No. 4,844,178 discloses a similar technique for operating two spaced-apart stabilizers interconnected by a common shaft. U.S. Pat. No. 4,848,488 discloses two spaced-apart stabilizers, and different flow rates may be used for independently controlling each of the stabilizers. A still further improvement in this type of adjustable downhole stabilizer is disclosed in U.S. Pat. No. 4,951,760.

U.S. Pat. No. 4,491,187 to Russell discloses an adjustable stabilizer wherein the alteration of drill string pressure are utilized to move a piston. A barrel cam mechanism is used to expand or retract the stabilizer blades. Fluid pressure within the stabilizer is equalized with fluid pressure in the well bore annulus in one embodiment, and the barrel cam mechanism is pressure balanced with internal fluid pressure in another embodiment. Pumping pressure may be reduced while the stabilizer blades are maintained in their outward position.

U.S. Pat. No. 3,627,356 discloses a deflection tool for use in directional drilling of a well bore. An upper and lower housing are pivotably connected, and a lower housing is coupled to a downhole motor to rotate the drill bit. Drilling fluid drives a piston and lever mechanism in the upper housing for urging the lower housing to pivot relative to the upper housing. A retrievable limiting probe is lowered into the deflection tool via wireline for setting a plug which limits the extent of pivotable movement. The deflection tool achieves the benefits of an adjustable bent sub, and utilizes a pressure differential between the tool bore and the well annulus to cause the pivoting movement of the upper assembly relative to the lower assembly.

The prior art adjustable downhole stabilizers have significant disadvantages which have limited their acceptance in the industry. Stabilizer adjustment techniques which require a change in weight-on-bit for activation are not preferred by drilling operators, in part because an actual weight-on-bit may be difficult to control, and since operator flexibility for altering weight-on-bit without regard to stabilizers activation is desired. Some prior art adjustable downhole stabilizers do not allow the radial position of the stabilizer blades to be reliably locked in place. Currently available downhole adjustable stabilizers have a large number of moving parts which frictionally engage, thereby reducing stabilizer reliability and increasing service and repair costs due to wear on these engaging components. Prior art stabilizers which utilize a pressure balanced system have additional complexities which further detract from their reliability and increase manufacturing and service costs. Some stabilizer adjustment techniques do not provide for monitoring the actual radial position of the stabilizer blades, but rather seek to accomplish this general goal in an indirect manner which lacks high reliability.

Improved methods and apparatus are required if the significant benefits of downhole adjustable stabilizers are to be realized in field operations. The disadvantages of the prior art are overcome by the present invention, and an improved downhole adjustable stabilizer and technique for adjusting a downhole stabilizer are hereinafter disclosed.

SUMMARY OF THE INVENTION

A relatively simple and inexpensive downhole adjustable stabilizer which has high reliability is provided by the present invention. The effective diameter of the stabilizer may be readily increased or decreased from the surface without the use of wireline or retrievable tools. The force used to expand the stabilizer blades is directly supplied by the differential pressure across the stabilizer. The stabilizer diameter may be locked in either its expanded or retracted position during normal drilling operations, so that the operator will have little concern for inadvertently changing the diameter of the stabilizer. A positive indication of the stabilizer diameter is provided at the surface as a function of the change in fluid pressure pumped through the drill string resulting from a varying orifice size directly related to a locked position. Actuation of the stabilizer may also be based on pressure differentials across the stabilizer, resulting part from fluid flow across the bit. A weight-on-bit sequencing technique in coordination with mud pump operation may optionally be used to allow this pressure differential to affect stabilizer diameter.

It is an object of the present invention to provide an improved downhole adjustable stabilizer which utilizes the pressure differential between an internal flow path in the stabilizer and the well bore annulus external of the stabilizer to directly increase the stabilizer diameter. A change in stabilizer diameter does not require complex activation of mechanical components and frictional engagement of numerous parts. A radially moveable piston is provided for each of the plurality of stabilizer blades. Radial movement of each piston is responsive to the pressure differential across the stabilizer, and is reliably effective to overcome a spring force acting on the blades and alter each blade position and thus the diameter of the stabilizer. Each piston moves a corresponding blade a fixed radial amount, although piston radial movement is preferably greater than the corresponding blade movement.

It is another object of the invention that a downhole adjustable stabilizer includes a plurality of blades which may be reliably locked in either their expanded or retracted position, and that the stabilizer position may be detected at the surface by the operator. The stabilizer blades are locked by fixing the radial position of each of the corresponding pistons, and the pistons may be secured by axial movement of a locking sleeve.

It is a feature of this invention that substantial flow changes of fluid passed through the drill string and the stabilizer are not required to change the stabilizer diameter, thereby increasing the versatility of the stabilizer for various applications. The stabilizer of the present invention may be reliably utilized in different wells, and changes in mud weight variations and flow rate variations do not significantly affect the ability to actuate the stabilizer when desired, while also preventing inadvertent stabilizer actuation.

It is a further feature of this invention that the differential pressure through the stabilizer may be used to lock the stabilizer blades in their desired expanded or retracted position. An axially moveable sleeve may be employed to lock each stabilizer blade in its expanded or retracted position, and movement of this sleeve affects the effective cross-sectional diameter of a port to provide a direct indication of a stabilizer position detectable at the surface based upon the back pressure in the fluid system. p It is an advantage of the present invention that high reliability for an adjustable downhole stabilizer is obtained by applying a pressure differential across the stabilizer to each of the plurality of stabilizer blades. This pressure differential may be applied over a relatively large area to produce a significant radial force to move each blade to its desired radially outward position.

It is also a feature of this invention that the downhole adjustable stabilizer and its operation are well designed for use with MWD operations, and that fluctuations in mud pressure caused by transmitted pulses will not detract from the reliability of the stabilizer and its operation.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
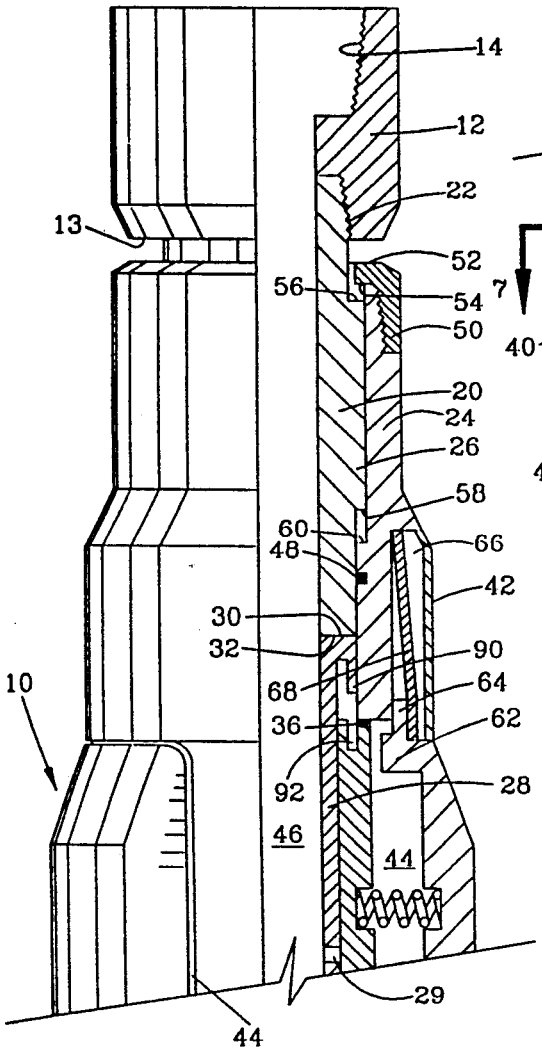
FIGS. 1 and 1A together are a half-sectional view of one embodiment of a downhole adjustable stabilizer according to the present invention in a neutral or run-in position.
Figure 1A:
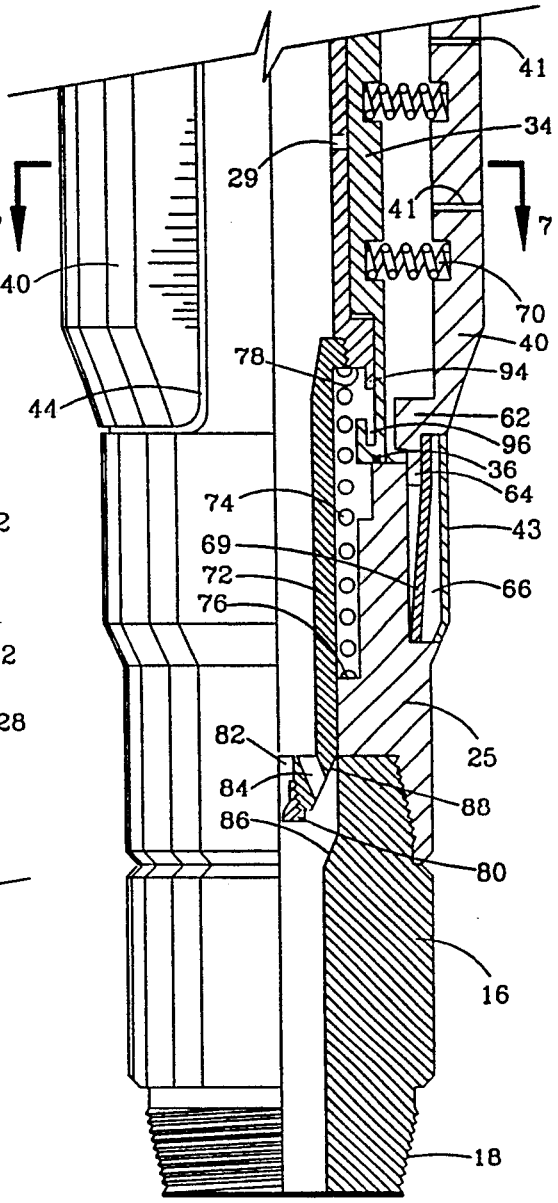

FIGS. 1, 1A, 2 and 3 depict one embodiment of a downhole adjustable stabilizer 10 according to this invention. Those skilled in downhole tools will readily understand that the bottom of FIGS. 1 and 4 are continued at the top of FIGS. 1A and 4A, respectively. Referring to FIG. 1, a top sub 12 of this stabilizer is provided with tapered sealing thread 14 for connection to an upper portion of a drill string (not shown). FIG. 1A depicts a bottom sub 16 of the stabilizer similarly provided with tapered threads 18 for sealing engagement with a lower portion of drill string (not shown). The top sub 12 is threadably connected to a weight actuating sleeve 20 by sealed threads 22. Body 24 of the stabilizer is rotationally fixed to the sleeve 20 by a plurality of conventional splines 26 in each of these respective members, thereby allowing axial movement of body 24 with respect to sleeve 20, while prohibiting rotational movement of the body with respect to the sleeve. A locking sleeve 28 is provided between the actuating sleeve 20 and lower sub 16, and includes an upper shoulder 30 for engagement with the lower shoulder 32 on the weight actuating sleeve.

A plurality of blade expanding pistons 34 are provided radially exterior of the locking sleeve 28, and each piston includes an annular seal 36 for continual sealing engagement with the body 24. A plurality of radially moveable stabilizer blades 40 are provided, with each of the blades 40 positioned radially outward of its respective piston 34. Each blade 40 is retained in position relative to the body 24 by respective upper and lower retainers 42, 43 each secured to the body 24 by a suitable means, such as a weld (not shown). It should be understood that the stabilizer 10 of the present invention includes at least one, and preferably three or more, stabilizer blades 40 positioned in a circumferential manner about the body 24 of the stabilizer. Each of these stabilizer blades is provided within a respective cavity 44 within the body 24.

Figure 2:
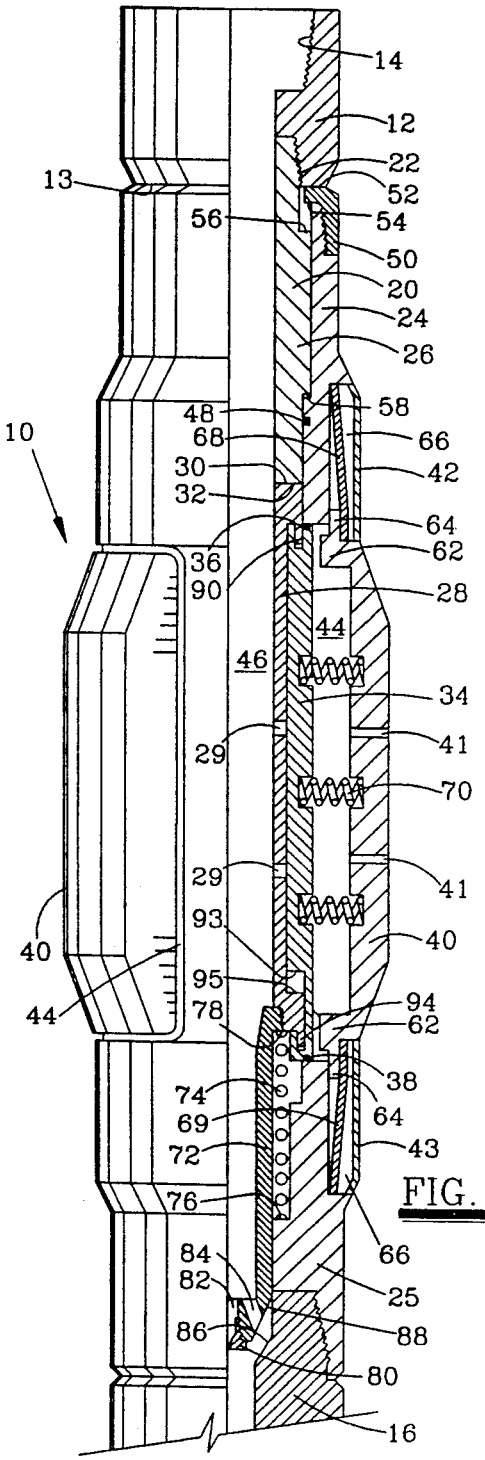
FIG. 2 is a half-sectional view of a stabilizer shown in FIG. 1 in a locked-in and reduced stabilizer diameter position.

The splined engagement of weight actuating sleeve 20 and body 24 allows drill string torque to be transferred from the top sub 12 through the body 24 and to the lower sub 16. The stabilizer 10 includes a central bore 46 for passing pressurized fluid from the surface through the drill string and to the bit (not shown). O-ring 48 carried on body 24, in conjunction with the piston seals 36, maintains a fluid-tight seal with the sleeve 20 to separate internal pressure within the flow passage 46 from pressure external of the stabilizer 10, with the external pressure being pressure in the annulus between the well bore and the downhole tool. Axial or telescoping motion of the body 24 with respect to the sleeve 20 is limited by retainer 50, which includes an upper surface 52 for engagement with the top sub 12 as the body moves toward the top sub 12. Retainer 50 also includes a lower surface 54 which engages stop surface 56 on sleeve 20 as the body 24 moves away from the top sub. When very large axial forces are applied to the drill string and through the stabilizer 10 to the bit, the shoulder 52 may thus engage the bottom surface 13 on sub 12 to transmit high weight-on-bit forces. During the application of weight-on-bit forces, the top surface 32 of the locking sleeve 28 also engages the bottom surface 30 of sleeve 20 to apply a substantial axial force to the locking sleeve, although the body 24 rather than the locking sleeve transmits the majority of the weight-on-bit forces to the bottom portion 25 of the body 24 and thus to the bottom sub 16. The only axial force transmitted through locking sleeve 28 are the forces required to overcome friction and spring 74. Also, a slight axial gap preferably exists between the lower surface of both 90 and 94 and the lower surface of the corresponding groove 92 and 96 when the stabilizer is locked in the minimum diameter position, as shown in FIG. 2. The shoulder 58 on weight actuating sleeve 20 moves with respect to shoulder 60 on body 24 as the body moves axially with respect to sleeve 20, although the spacing of components preferably is such that surfaces 52 and 13 engage to limit axial movement of components before the surfaces 58 and 60 engage.

Each of the stabilizer blades 40 is provided with a respective upper and lower radially inward-directed ledge for mounting each blade in a respective cavity 44 within the body 24. Axially extending flanges 64 are fixed to the upper and lower ledges for fitting within pockets 66 provided between the respective upper and lower retainers 42, 43 and the body 24. An upper leaf spring 68 and a corresponding lower leaf spring 69 are also provided in each of the respective pockets 66 for biasing each of the blades 40 toward a retracted position. When the blade moves radially outward, as explained hereafter, the axially extending flanges at the ends of each blade press against and move the leaf springs radially outward, with final movement being limited when the leaf springs engage the inner surface of the retainers 42 and 43. Each of the retainers 42, 43 may be fixed to the body, and each of the leaf springs 68, 69 may be secured to the body by suitable means, such as screws (not depicted).

A plurality of coil springs 70 are provided between each of the pistons 34 and its respective stabilizer blade 40. Each of these springs may be held in position by respective bores provided in both the piston 34 and the blade 40, as depicted. Springs 70 are preloaded with a sufficient force to maintain the piston 34 radially inward and against the locking sleeve 28, although the force of the spring 70 is less than the radial force provided by the leaf spring 68, 69 which maintain the blades in their radially inward position. When the piston 34 moves radially outward, as explained hereafter, this radial movement first compresses the springs 70 until the piston engages the inner surface of its respective blade, so that further movement of the piston then presses the blade 40 outward to move the leaf springs 68, 69 toward engagement with the retainers 42 and 43. It should thus be understood that the radially outward movement of each piston 34 may be greater than the radially outward movement of the corresponding blade 40.

A locking sleeve extension 72 is threadably connected to the lowermost end of the locking sleeve 28, and locking sleeve return spring 74 is compressed between the lower surface 76 on the body 24 and the surface 78 on the locking sleeve. Spring 74 thus biases the locking sleeve upward so that its surface 30 is in engagement with the surface 32 on the sleeve 20. The locking sleeve extension 72 includes a jet nozzle 80 having a central passageway 82 therein defining a nozzle restriction, while a plurality of peripheral ports 84 are provided in the lowermost end of the locking sleeve extension 72. The frustoconical sealing surface 86 on the body 16 is designed for cooperation with the surface 88 on the locking sleeve to substantially close off flow through the plurality of ports 84 when these surfaces engage.

As explained in further detail below, the stabilizer blades 40 are moved radially outward as a function of the normal flow rates of fluid through the stabilizer. Fluid pressure thus acts upon the inner face of each of the pistons 34, while the annulus pressure, which is less than the internal pressure, acts on the opposing outer face of the piston 34. The locking sleeve 28 does not seal the inner face of pistons 34 from the internal stabilizer pressure in central flow path 46, and a plurality of ports 29 may optionally be provided through the locking sleeve 28 to ensure that the inner face of the piston is exposed to the internal stabilizer pressure. Similarly, the stabilizer blades 40 do not prevent annular pressure in the well bore from acting on the outer face of the pistons, and ports 41 may optionally be provided through the stabilizer blades. This pressure differential and the size of the piston generates a considerable force which is used to radially press each of the blades outward. This technique for moving the blades outward does not use a changing weight-on-bit force. Moreover, the technique of the present invention does not require maintaining a sealed, pressure balanced system across the stabilizer, using balanced pistons or diaphragms, and in fact relies upon the pressure differential across the piston seals 36. The preloaded biasing force of the springs 68, 69 maintain the blades normally radially inward or retracted when flow rates through the stabilizer 10 are low and/or when the pressure differential across the stabilizer is low. This feature allows a relatively small weight-on-bit force to be used to sequence the stabilizer to a locked and reduced diameter position, as explained subsequently, so that the blades are maintained in the retracted position when flow rates through the tool increase to normal. For the present, however, it should be understood that the ability of the stabilizer 10 to maintain the blades in the retracted position at low flow rates, rather than at no flow rates, prevents bit sticking in soft formations when small weight-on-bit force is applied, which is a significant problem if fluid flow is terminated. Also, the blades will normally be in the retracted position when the stabilizer 10 is tripped in and out of a well bore. Coil springs 70 acting between the piston and each stabilizer blade produce a lesser preload on each blade than the leaf spring 68, 69, although the coil springs 70 are sufficiently preloaded to maintain the pistons in the full radially inward position at low flow rates. Radial movement of each of the pistons 34 may be substantially greater than blade movement, which is one advantage of not having the piston integral with its respective blade. This increased radial movement of the piston 34 with respect to blade 40 permits interlocking protrusions and grooves on the locking sleeve and piston (discussed subsequently) to be substantially thick for reliable strength. As the flow rate through the stabilizer is increased to a normal flow rate and the stabilizer is not in a locked position, each of the pistons 34 will move radially outward to compress the preloaded coil springs 70 until the piston 34 contacts its respective blade 40. As flow is further increased, the pressure differential acting on each piston will force the corresponding blade to overcome the preloaded leaf spring 68, 69, thereby expanding the blades to their maximum position.

It is a feature of the stabilizer 10 that the blades may be locked in their last selected position independent of weight-on-bit and stabilizer blade sideloading forces from the well bore, as long as the surface pumps are passing normal fluid flow through the stabilizer. The weight actuating sleeve 20 is structurally isolated from the locking sleeve 28. Sleeve 20 is splined to the stabilizer body 24, and axial movement of sleeve 20 and body 24 is limited, as provided above. The O-ring 48 is provided for maintaining a seal between sleeve 20 and body 24, and is subject to the pressure differential between the internal pressure in the stabilizer and the annulus pressure. During normal flow, this substantial pressure differential always acts on the piston 34, and high frictional engagement of the piston and the locking sleeve 28 while retracted prevents the stabilizer from unlocking, even if no weight-on-bit is applied or if high radially inward forces are acting on one or more of the blades 40. Moreover, the differential pressure forces across the sleeve extension 72 at normal flow rates further assist in preventing the locking sleeve from moving to the unlocked position.

Figure 3:
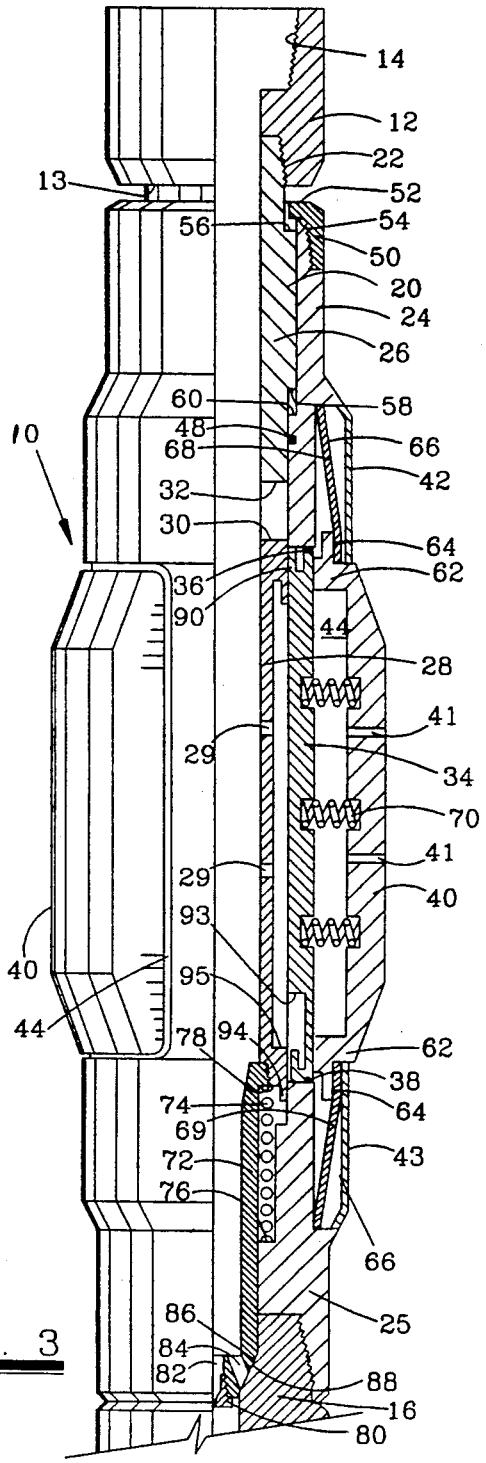
FIG. 3 is a half-sectional view of the stabilizer shown in FIG. 1 in a locked-in and expanded stabilizer diameter position.
Figure 4:
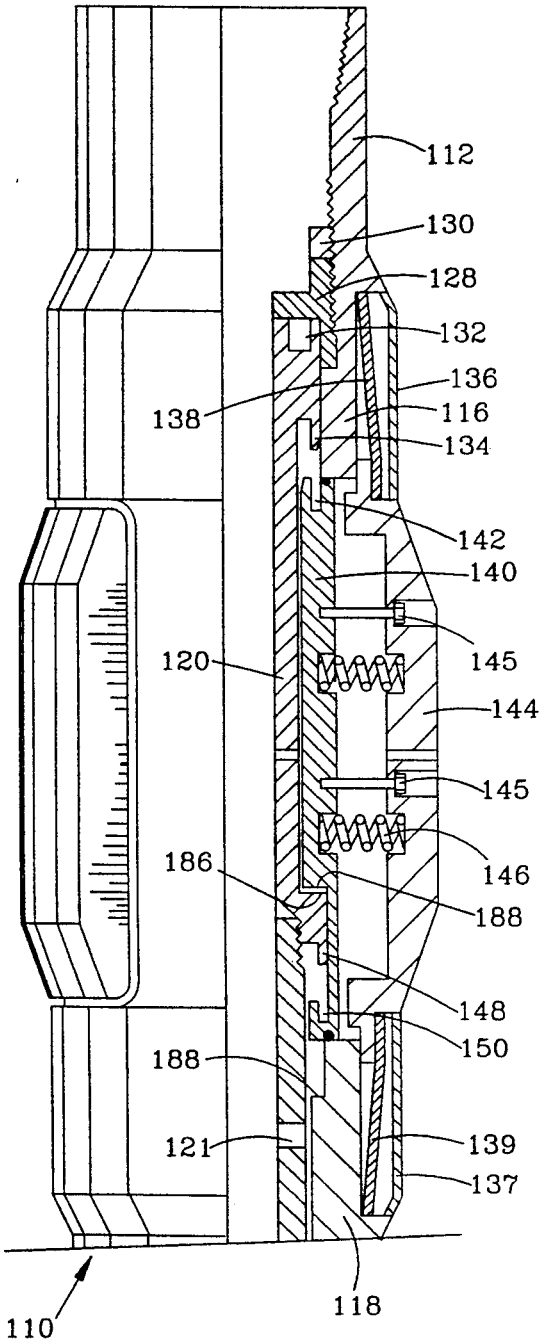
FIGS. 4 and 4A together are a half-sectional view of another embodiment of a stabilizer according to the present invention in its neutral or run-in position.

In order to intentionally unlock the stabilizer 10 after it has been locked in the position as shown in FIGS. 2 or 3, the drill string is lifted off bottom and the pumps are shut down or flow through the stabilizer otherwise reduced to below normal rates. The stabilizer 10, if not in its retracted position, may thus be sequenced to this position as shown in FIG. 1 and 1A by lifting the bit off the bottom and maintaining a low flow rate through the stabilizer. During these simultaneous actions, the leaf springs 68, 69 bias the blades inward against the body 24, the coil springs 70 bias the pistons 34 to the inward position against the sleeve 28, and the coil spring 74 biases the sleeve 28 to the position as shown in FIG. 1, with surfaces 30 and 32 engaging. The spring 74 is thus sufficient to overcome any slight downward force of the locking sleeve 28 caused by a slight pressure differential over the axial length of the stabilizer, provided fluid flow rates are low.

To sequence the stabilizer from its neutral to its retracted and locked position, a relatively small weight-on-bit may be applied to overcome the force of spring 74, while still maintaining low flow rates. This axial force causes surfaces 32 and 30 to engage, causing the locking sleeve 28 to telescope downward with respect to the piston 34, such that locking flange or ring 90 on the locking sleeve fits within an annular recess 92 in the piston 34. As shown in FIG. 2, this action effectively causes the body 24 to move up with respect to the top sub 12, so that surfaces 52 and 13 engage and minimize the spacing between surfaces 58 and 60 (compare FIGS. 2 and 3). This action also causes the similar locking flange 94 at the lower end of the sleeve 28 to engage the corresponding annular groove 96 in the piston, thereby causing the separation of surface 93 on the piston and mating surface 95 on the locking sleeve. Once this locking sleeve has been moved to the position as shown in FIG. 2 and the sleeve 28 and piston 34 interlocked, it should be understood that the subsequent increase in flow rates will not allow the piston 34 to move radially outward, since this movement is prevented by the locking sleeve 28 in engagement with pistons 34. Once locked in the position as shown in FIG. 2, flow rates may thus be increased without affecting stabilizer diameter. The bit may then also normally be picked up off bottom without a change in the diameter of the stabilizer. With the locking sleeve and piston interlocked as shown in FIG. 2, the surface pump speeds will normally be passing more than low fluid flow rates through the stabilizer. The pressure differential caused by these normal flow rates attempts to move the piston 34 outward, but the stabilizer is locked in this minimum gauge position. The only force tending to move the locking sleeve back to its unlocked position is the biasing force of the spring 74. While normal flow is maintained through the stabilizer, the substantial frictional force resulting from the interlocking of the sleeve 28 and the piston 34 is sufficient to prevent this biasing force from unlocking the stabilizer. The weight-on-bit may accordingly be removed or increased without changing stabilizer diameter.

To unlock the stabilizer 10 after it has been locked in its minimum gauge position as shown in FIG. 2, the drill string is lifted so that the bit is off bottom and the mud pumps are shut down (or flow is at least substantially reduced). Shutting down the mud pumps removes forces due to differential pressure, and the only friction force resisting unlocking results from the coil springs acting on the piston and against the locking sleeve. Any possible difficulty in achieving the unlocked position may be overcome by increasing surface mud pump speed slowly to increase flow rate so that this coil spring force is balanced or overcome by the differential pressure force on the piston, so that spring 74 returns the stabilizer to the position as shown in FIGS. 1 and 1A.

To sequence the stabilizer from its neutral to its expanded position, flow through the stabilizer is increased to its normal level by activating the pumps at the surface while the bit remains off bottom. This increased flow rate results in a significant pressure differential across the stabilizer, i.e., the pressure within flow path 46 becomes substantially greater than the pressure external of the stabilizer and in the well bore annulus. This increased pressure differential acts upon the pistons 34 to move each piston 34 and its respective blade 40 radially outward.

To lock the stabilizer 10 in the expanded position as shown in FIG. 3, weight-on-bit force is not employed, but rather the pressure drop through the stabilizer is used to axially move the locking sleeve. The stabilizer spring 74 and the restriction at the lower end of extension 72 are sized so that when the surface pumps are actuated and pressure is increased, the differential pressure across the stabilizer will first cause the pistons 34 to move the blades to their outward position, as previously described. As the surface pump speeds are increased to pass more fluid through the stabilizer, the pressure differential created by the restrictions at the lower end of extension 72 create a downward force which acts against and overcomes the return spring 74, so that the locking sleeve moves down and now is positioned entirely radially inward of each of the pistons. During this movement, the radially outermost surface of the lower end of the locking sleeve slides axially downward and radially inward of the lower portion 25 of the body, so that the radially outmost surface of the locking sleeve 28 is "behind" or radially inward of pistons 34. This further downward movement of the locking sleeve with respect to the body further compresses the spring 74, and causes the frustoconical surface 88 to engage the seating surface 86 on the body. During this process of locking the stabilizer in the expanded position, no weight-on-bit forces are applied. It should also be understood that each of the pistons and its respective blade may be locked in their radially outward position before the surfaces 88 and 86 engage, and until these surfaces engage fluid flow through the stabilizer may pass through both the ports 84 and the central passageway 82 through the nozzle 80. Once the surfaces 86 and 88 engage, as shown in FIG. 3, all flow through the stabilizer must be through the center port in the nozzle 80, and the pressure differential across the locking sleeve will substantially increase, thereby increasing the axial downward force of the locking sleeve on the surface 86. The locking sleeve will thus move down to lock the stabilizer in the expanded position as shown in FIG. 3 without the application of weight-on-bit forces, and rather in response only to the increased flow through the stabilizer from a minimal amount to the normal flow rate. This increased flow causes an increased downstream pressure differential through the bit nozzle 80 and the peripheral holes 84. The axial force on the locking sleeve 28 is thus increased by restricting the flow through the bottom portion of the stabilizer 10, thereby increasing the differential pressure across the jet nozzle 80. With the stabilizer 10 locked with each of the blades 40 radially outward and each piston positioned entirely radially outward of the locking sleeve 28, weight on the bit may be applied and may subsequently be removed and re-applied without affecting stabilizer diameter. While normal fluid flow is maintained, the substantial pressure differential acting axially downward on the locking sleeve 28 prevents unlocking, since the only force tending to move the sleeve 28 back to the unlocked position is the return spring 74.

In order to unlock the stabilizer 10 from the locked position as shown in FIG. 3, the drill string may be lifted off bottom and the pumps shut down or reduced so that there is virtually no fluid flow or little flow through the stabilizer 10. This action causes the locking sleeve return spring 74 to move the locking sleeve to the position as shown in FIG. 1, so that the surface 93 on each piston again radially overlaps the surface 95 on the locking sleeve, thereby allowing the spring 68, 69 to return the blades 40 to the retracted position.

Stabilizer 10 as shown in FIGS. 1-3 also has the capability of providing a positive or direct indication of the position of the stabilizer blades 40 to the operator at the surface. With the stabilizer positioned as shown in FIG. 3 in the locked maximum diameter position, the fluid pressure at the surface will increase and remain at a significantly higher level than the surface pressure when the stabilizer is locked in the minimum diameter position as shown in FIG. 2. When the stabilizer is actuated from the unlocked position as shown in FIG. 1 to the locked and retracted position as shown in FIG. 2, there is no appreciable change in surface pressure level at normal flow rates. However, if the stabilizer is not properly locked in the retracted position, the pressure level at the surface will increase, since the locking sleeve will then move to the position as shown in FIG. 3. Such an increase in pressure would thus indicate to the drilling operator that the stabilizer has not been locked in the retracted position, but rather that the stabilizer had inadvertently locked in the expanded position. With this information, the drilling operator can take corrective action to return the stabilizer to the neutral position as shown in FIG. 1, then initiate the sequence of steps outlined above to lock the stabilizer in the locked and retracted position as shown in FIG. 2. From the above, it should be understood that the operator will be readily able to detect a substantial increase in fluid pressure indicative of the stabilizer intentionally being locked in the expanded position as shown in FIG. 3 compared to the fluid pressure if the stabilizer is locked in the retracted position of FIG. 2.

The stabilizer as shown in FIGS. 1-3 allows weight-on-bit to be used to telescope the locking sleeve 28 to the minimum stabilizer diameter as shown in FIG. 2, and increased flow through the stabilizer to telescope the locking sleeve to the maximum stabilizer diameter position as shown in FIG. 3. Once in its locked position, this technique desirably does not allow either pressure differential forces (between the internal flow path in the stabilizer and the annulus pressure) or negative weight-on-bit loads (when pulling out of the bore) hole to force the locking sleeve to its unlocked position. The weight-on-bit required to move a locking sleeve from its neutral position to the locked and retracted position as shown in FIG. 2 must only overcome the following loads: (a) the force of a locking sleeve return spring 74, (b) frictional forces on O-ring 48 between the sleeve 20 and body 24, (c) friction of the splines 26 between the sleeve 20 and body 24, (d) the pressure differential force across the bit, which creates an upward (drill string separation) force which may be quite high if flow rates are high and must be overcome by the downward weight-on-bit force, and (e) frictional forces from the coil springs 70 on the pistons 34 pressing against the sleeve 28, less the differential pressure forces acting on the piston 28 acting to compress the springs 70. Similarly, the differential pressure across the jet nozzle 80 and across the peripheral holes 84 creates a downward force to lock the stabilizer in its expanded and locked position. This axially downward force created by this pressure differential through the stabilizer must overcome the force of the locking sleeve return spring 74. The spring 74 and the ports at the lower end of extension 72 are thus selectively sized to first result in full radial outward movement of the piston in response to the increased pressure differential across the stabilizer as flow through the stabilizer increases. As a result of further increased flow through the stabilizer and the corresponding increased pressure differential through the stabilizer, the spring 74 thereafter compresses to move the locking sleeve 28 to its downward locked and stabilizer expanded position.

It should be noted that pressure differential forces acting on the locking sleeve (due to restrictions 82 and 84) will reduce the required weight-on-bit forces needed to move the locking sleeve to the FIG. 2 locked and retracted position. When the bit is off bottom and the flow rates through the stabilizer are low, the locking sleeve will reliably be maintained in the unlocked position as shown in FIG. 1 by the coil spring 74. When the radially outer surface of the locking sleeve is positioned entirely radially inward of the pistons as shown in FIG. 3, the blades cannot retract during drilling even if the radially inward forces on the blades applied to any of the pistons exceed the radially outward force on the piston less the force of the leaf springs 68, 69.

Figure 5:
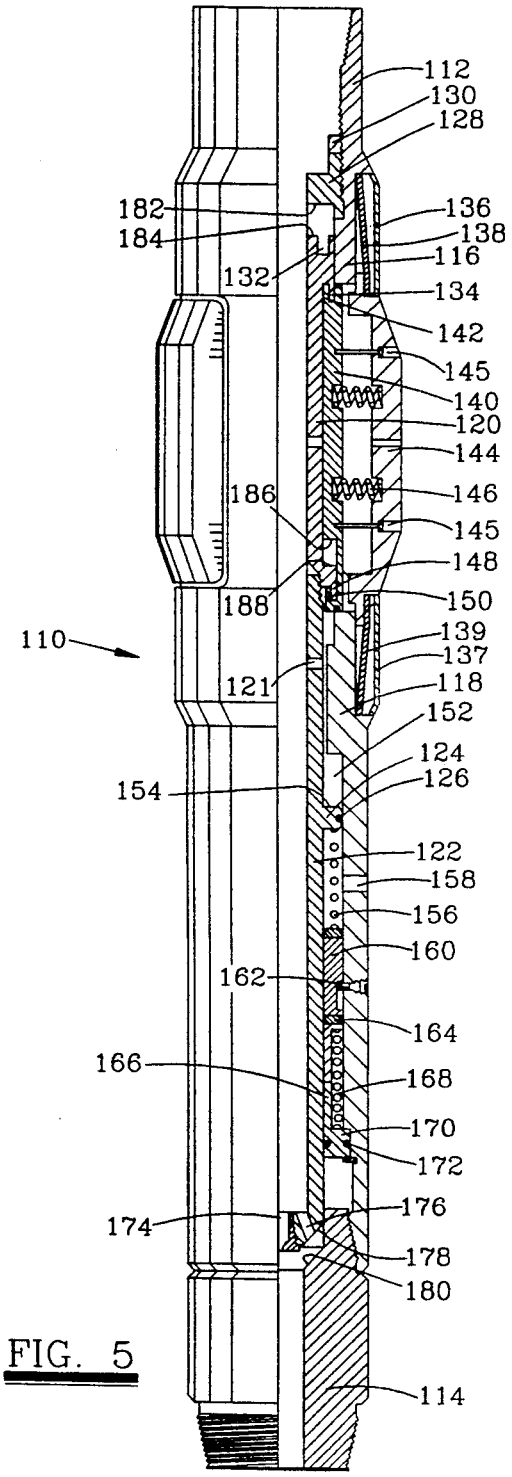
FIG. 5 is a half-sectional view of a stabilizer shown in FIG. 4 in a locked-in and reduced stabilizer diameter position.
Figure 6:
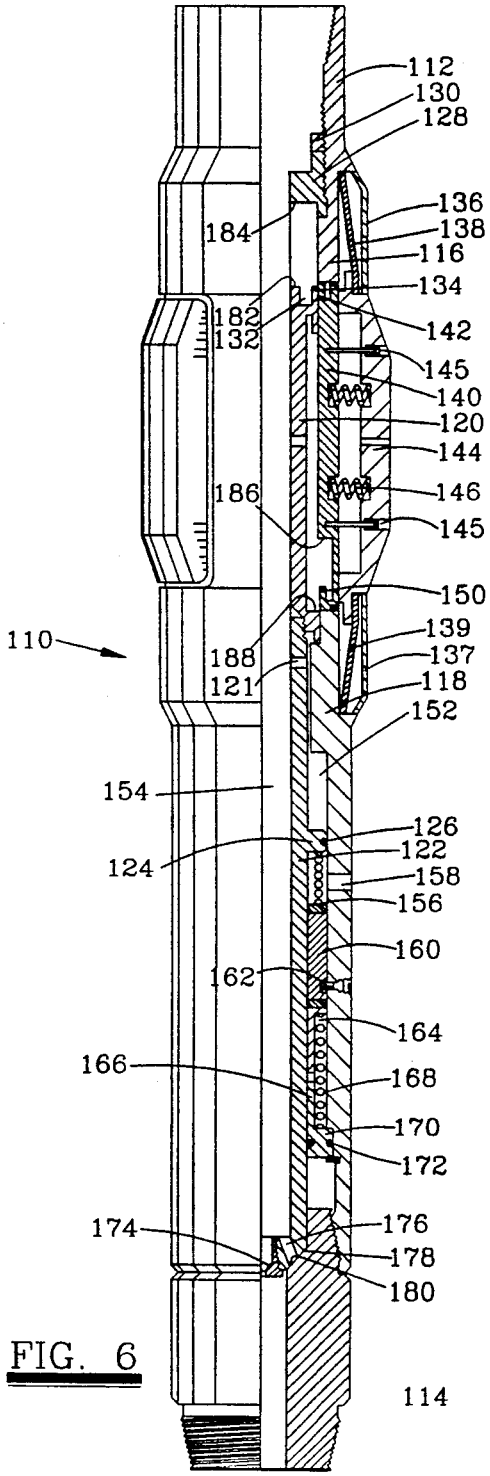
FIG. 6 is a half-sectional view of the stabilizer shown in FIG. 4 in a locked-in and expanded stabilizer diameter position.

FIGS. 4-6 depict another embodiment of a stabilizer according to the present invention. The diameter of the stabilizer described above and depicted in FIGS. 1-3 is responsive to or actuated by pressure differential across the stabilizer (which is primarily the sum of the pressure differential through the stabilizer plus the significantly larger pressure differential through the drill bit and, if provided, through a drill motor or similar downhole pressure responsible tool), and this FIG. 1-3 embodiment is sequenced or controlled to a large extent by the application or lack of application of weight-on-bit during increased flow from low to normal through the stabilizer. The stabilizer discussed subsequently and shown in FIGS. 4-6 is similarly actuated by pressure differentials across the stabilizer, but is also sequenced or controlled by this pressure differential, thereby desirably allowing the operator to control and sequence the stabilizer without the application of weight-on-bit forces at below normal flow rates.

Figure 4A:
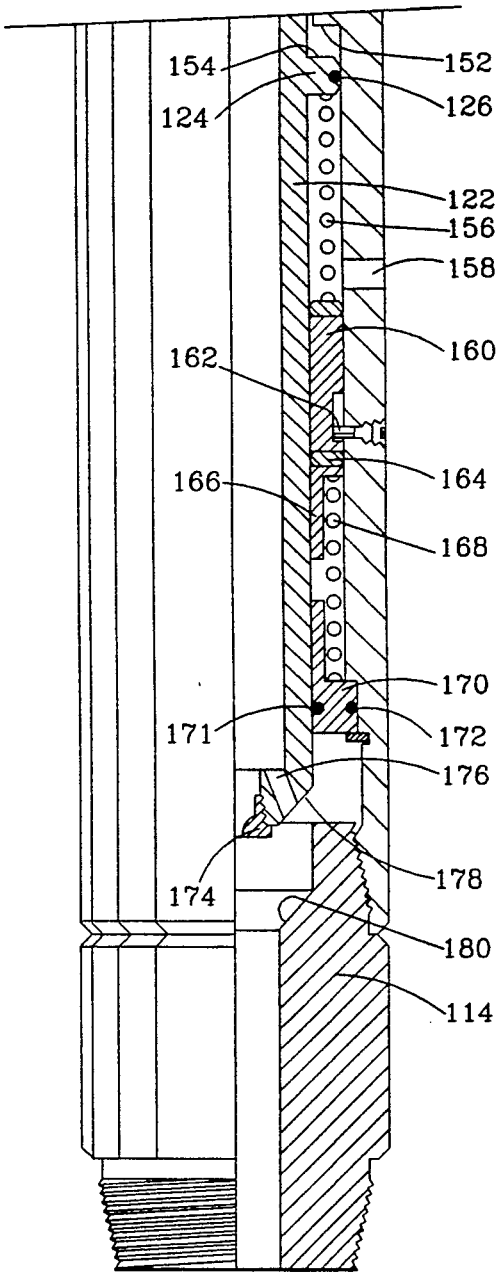

The stabilizer 110 as shown in FIGS. 4 and 4A is similar to stabilizer 10, and the primary structural and functional differences are discussed below. The bottom sub 114 is interconnected to the stabilizer body 116, while the top sub 112 is an integral part of the stabilizer body. Stabilizer body 116 has a lower body portion 118 which extends substantially below the stabilizer blades, so that body 116 is structurally longer than the body 24 of the stabilizer 10. A lower end of the locking sleeve 120 is threadably connected to sleeve extension 122, which has an integrally secured annular piston 124 thereon having O-ring 126 for sealing engagement with an internal surface of the body 116. A retainer 128 is threadably connected to the top sub 112, and locking ring 130 substantially acts as a back-up nut to prevent inadvertent rotation of the retainer 128. The top surface of the locking sleeve 120 is biased against the lower surface of the retainer 128.

A plurality of tie bolts 145 interconnect each piston 140 and its corresponding blade 144, so that the inner surface of pistons 140 is prevented by the tie bolts 145 from engaging the locking sleeve 120. When the stabilizer 110 is in the locked position as shown in FIG. 6, the tie bolts 145 become relaxed and no longer functionally interconnect pistons 140 and locking sleeve 120. This tie-bolt feature eliminates the frictional forces acting between pistons 140 and locking sleeve 120 when the stabilizer is moved from the runnin to the locked and retracted position, and visa versa, and effectively removes the biasing force of coil springs 146 acting on the pistons 140 from being transmitted to the locking sleeve 120. One or more holes 132 located about the periphery of the upper surface of locking sleeve 120 are provided for imparting a torque to threadably connect sleeve 120 with extension 122. Annular ring 134 mates with slot 142 in piston 140, and similarly ring 148 mates with slot 150, as previously described. Retainers 136 and 137, leaf springs 138 and 139, piston 140, blade 144, and coil springs 146 are equivalent to components described above. Surfaces 186 and 188 are functionally equivalent to surfaces 93 and 95 in the previously-described embodiment, and nozzle 174, ports 176, and surfaces 178 and 180 functionally correspond to components 80, 84, 88 and 86 in that previously-described embodiment, respectively. Both the locking sleeve 120 and the blades 144 may have through ports as previously described to ensure that the pistons 140 are subject to the full differential pressure across the stabilizer.

Locking sleeve extension 122 is threadably secured to locking sleeve 120, and integral piston 124 provided on lock sleeve extension 122 carries an annular seal 126. Note that when the locking sleeve 120 is axially closest to the top sub 112, as shown in FIG. 4, upper face 154 of the piston preferably still is out of engagement with top surface 152 of the body 116. Locking sleeve return spring 156 acts upon piston 124 to bias the locking sleeve to the neutral or run-in position, and port 158 provides fluid communication from the well annulus to the lower or bottom face of the piston, irrespective of axial movement of the piston 124. An axially movable ring 160 which serves as a retainer is positioned with respect to body 116 by pin 162, which is spring biased radially inward. The ring 160 acts in a manner of a barrel cam, and cooperates with pin 162 to cause ring 160 to move axially in a racheting manner. Bearing rings 164 are provided above and below the ring or retainer 160 to facilitate easy rotational movement of the retainer with respect to the body. A second spring 168 acts between an upper surface of ring 166 in engagement with lower bearing member 164, and lower member 170. The lower end of spring 168 acts against member 170, which is axially prevented from movement with respect to the body 116. Member 170 has an L-shaped cross-sectional configuration, and annular member 170 carries seals 171 and 172 for sealing engagement between 170 and the sleeve extension 122 and body 116, respectively.

Retainer 160 includes a series of interconnecting long and short slots. Pin 162 moves within these slots in a reciprocating manner similar to that disclosed in U.S. Pat. No. 4,821,817 to Cendre. In the neutral or run-in position as shown in FIGS. 4 and 4A, the long slot allows retainer 160 to move axially upward in response to spring 168, while spring 156 biases the locking sleeve 120 upward by engagement with piston 124, as shown in FIG. 4A, when the retainer 160 is axially away from the lower sub 114 and pin 162 is in the lower end of a long slot. The spring 168 and spring 156 are thus sized with a biasing force to maintain the stabilizer 110 in the position as shown in FIG. 4 as long as there is no or extremely low flow through the stabilizer. As flow increases to normal rates, the locking sleeve 122 moves downward in response to a relatively slight axial force caused by the pressure differential across the nozzle 174, and the pressure differential across the stabilizer (this latter pressure differential being the interior stabilizer to exterior stabilizer differential primarily attributable to the bit pressure drop and pressure drop through a mud motor, if used) acting on the piston 124, with this axial force being relatively great. The top face 154 of the piston 124 is thus subject to fluid pressure within the stabilizer, while the annulus pressure provided through port 158 acts on the opposing lower face of the piston 124. This action thus causes the locking sleeve to move downward as shown in FIG. 5 to interlock the piston 140 and the locking sleeve 120 in the manner previously discussed, so that 134 fits within 142, while 148 fits within 150. The spring 168 always maintains an upward bias on retainer 160, but is a relatively soft spring (weak spring rate). Spring 156 is a comparatively stiff spring (strong spring rate), but only exerts a substantial upward force on piston 124 when the retainer 160 is limited to its substantially axially upward position relative to pin 162 (short slot), and the axial spacing between the piston 124 and the retainer 160 is significantly reduced by the downward movement of the locking sleeve. The force of spring 156 is thus high when retainer 160 is in its short slot (retainer 160 remains substantially upward, yet the spring 156 is exerting a substantial downward force on the retainer) and the locking sleeve 120 is moved downward to its locked and expanded stabilizer diameter position, as shown in FIG. 6. The axial downward movement of the locking sleeve 120 to its locked and retracted position, as shown in FIG. 5, thus further compresses weak spring 168, while stiff spring 156 maintains a low upward biasing force on piston 124 since the axial spacing between the piston 124 and the retainer 160 only slightly decreases in length compared to the run-in position as shown in FIGS. 4 and 4A (retainer 160 moves downward in the long slot as piston 124 moves downward). With the stabilizer in the locked-in retracted position as shown in FIG. 5, the piston 140 and thus the blades 144 are prevented from expanding as flow rates further increase during normal drilling operations.

To sequence the stabilizer 110 from the locked and retracted position as shown in FIG. 5 to the locked and expanded position as shown in FIG. 6, the stabilizer is first returned to the neutral position as shown in FIGS. 4 and 4A. This may be accomplished by shutting off the mud pumps (or substantially reducing the flow below normal rates) so that the absence of pressure differential across the piston 124 (or the slight pressure differential which may exist at very low flow rates) allows the spring 168 to sequence pin 162 to a short slot position. This reduced pressure is also insufficient to overcome the biasing force of spring 156, thus causing the locking sleeve 120 to return to the position as shown in FIG. 4. This action thus simultaneously sequences the retainer 160 from a long slot to a short slot, so that the retainer 160 is axially held by spring 168 in its upper position, and spring 156 thereby maintains a substantial biasing force on the piston 124. When the drilling flow rate is thereafter increased from a low (or pump-off rate) to higher pressure (still substantially less than normal drilling rate), spring 156 has a substantially increased biasing force (stiff spring rate) acting on the piston 124 compared to the biasing force of the mode as shown in FIG. 4A, and this higher biasing force initially does not allow the locking sleeve to move downward to interlock the piston 140 and locking sleeve 120. Rather, this first increase in fluid pressure will cause the piston 140 to move radially outward as flow rate increases, thereby pressing the corresponding blades 140 radially outward. A then further increase in fluid pressure (to a level still less than normal drilling pressures) after the blades 144 have moved to their expanded stabilizer diameter position will overcome the stronger biasing force of the spring 156, so that the locking sleeve 120 will thereafter move downward "behind" the pistons (locking sleeve 120 being completely radially inward of the pistons 140), so that the locking sleeve 120 prevents the pistons 140 and thus the blades 144 from moving radially inward when substantial radial inward forces are applied to one or more of the blades. During this substantial axial movement of the locking sleeve 120, axial movement of retainer 160 is limited since it is maintained in the short slot, and stiff spring 156 (rather than soft spring 168) is thus compressed by the pressure differential across the stabilizer acting on the piston 124. The stabilizer 110 as shown in FIG. 6 thus effectively becomes locked in the expanded diameter position.

Stabilizer 110 may be returned to its neutral position by terminating or reducing substantially below normal rates the flow through the stabilizer 110, which will cause the locking sleeve 120 to return to the position as shown in FIG. 4. The stabilizer 110 may thereafter be selectively sequenced to the locked-in retracted position or the locked-in expanded position by turning on and off the mud pumps as described above, with the operator realizing that the on/off sequence of these pumps each time will reciprocate the retainer 160 from the short slot position to the long slot position. A subsequent on/off sequence will cause the retainer 160 to again sequence from the long slot position to the short slot position, and this action may subsequently be repeated until the desired position is obtained.

A positive indication of the blade position is provided for the drilling operator to determine whether the stabilizer is locked in the minimum diameter position as shown in FIG. 5, or the maximum diameter position as shown in FIG. 6. Surface pressure will be at a significantly higher level when the stabilizer is locked in the maximum gauge position, since all flow through the stabilizer must pass through the nozzle 174, and flow through the ports 176 is substantially prohibited by engagement of the frustoconical surfaces 178 and 180. The surface pressure when the stabilizer is locked in the retracted position as shown in FIG. 5 will thus be markedly lower at normal flow rates than the surface pressure when the stabilizer is locked in the position as shown in FIG. 6.

The stabilizer as shown in FIGS. 4–6 has several significant advantages over the stabilizer shown in FIGS. 1–3. Since the stabilizer does not require sequencing with a change in weight-on-bit, the operator does not need to manipulate both flow and weight-on-bit to sequence the stabilizer to its locked and retracted position. A feature of the FIGS. 4–6 embodiment is that weight-on-bit may be applied or not applied at low flow rates without sequencing the stabilizer, while the FIGS. 1–3 embodiment requires weight-on-bit application at low flow rates to sequence the stabilizer to the locked and retracted position. Both weight-on-bit and torque are transmitted directly through the body of the stabilizer, so that no splined connection between the stabilizer body and an actuating sleeve is required for the FIGS. 4–6 embodiment. Since weight-on-bit sequencing is not employed, the stabilizer may be easily and quickly sequenced by simply turning on and off the mud pumps, thereby reducing rig time. The sequencing of the stabilizer is independent of normally-encountered variations in mud density, and close monitoring of fluid flow rate is not essential. While the amount of the back pressure at the surface to provide a positive indication of stabilizer position is dependent on mud density and flow rate, this back pressure may be easily adjusted by changing the jet nozzle 174.

The primary force acting to move the locking sleeve downward is the pressure differential across the piston 124. Accordingly, the operation of the stabilizer does not require any substantial pressure drop across the stabilizer itself, so that the jet nozzle 174 can be entirely removed and an extension 122 utilized which does not substantially restrict flow at the lower end thereof. The pressure drop across the tool may thus be minimized, although a slight pressure drop is beneficial to provide the positive indication of stabilizer position, as noted above. High internal stabilizer flow velocities that result in erosion are not required for complete stabilizer operation. A carefully machined and complex dart and orifice system need not be utilized, and the stabilizer may be manufactured without expensive erosion-resistance materials.

Stabilizer 110, like the stabilizer 10 previously described, uses pressure differential across the stabilizer to move the blades radially outward. The combination of the retainer 160 and the selected biasing force of the two springs 156 and 168 thus enable the stabilizer 110 to be desirably sequenced without the use of weight-on-bit forces. Stabilizer 110 preferably uses the same pressure differential across the stabilizer to both move the stabilizer blades outward, and to sequence the stabilizer.

Figure 7:
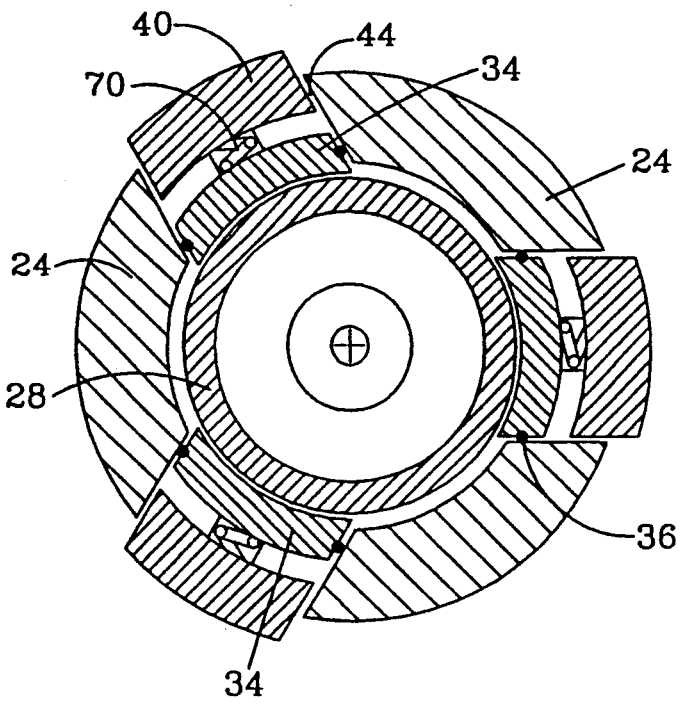
FIG. 7 is a cross-sectional view of the stabilizer shown in FIG. 1, illustrating the relative position of multiple stabilizer blades with respect to the body.

FIG. 7 depicts in cross-section the stabilizer 10 shown in FIG. 1, and illustrates exemplary proportions of three circumferentially spaced and radially movable blades 40 with respect to the stabilizer body 24. Each stabilizer blade is radially movable in response to a corresponding piston 34, which in turn is subject to the pressure differential across the stabilizer. The piston seal 36 shown in FIGS. 1–3 encircles the piston 34 and is depicted in FIG. 7. The locking sleeve 28 is radially inward of the pistons 34, and moves axially to lock the piston (and indirectly the blades 40) in either the expanded or retracted positions.

As still a further embodiment of a stabilizer according to the present invention, the piston 124 and ports 158 and 121 may be eliminated. The lower end of the extension 122 may terminate in the vicinity of retainer 160, which in turn has an axially inward-projecting restriction surface defining an orifice for pressure control. The sleeve extension has a smaller diameter than the embodiment as shown in FIGS. 4–6, and is tapered inwardly to a central dart, and ports through this tapered region allow fluid flow to pass from the interior of the extension to the annulus between the retainer and the central dart. The spring 156 may be moved radially inward since the extension 122 has a smaller diameter, so that the upper end of the spring 156 engages the lower end of the locking sleeve. The dart and flow restriction member may act in a manner functionally equivalent to similar components disclosed in European Patent Application 90307273.4, hereby incorporated by reference. In other respects, this stabilizer embodiment may be as depicted in FIGS. 4–6.

In this latter embodiment, the spring 156 will preferably still have a stiff spring rate, and selectively biases the locking sleeve and thus the extension upward. The spring 168 will have a relatively weak spring rate, and continually biases retainer 160 to its upper position, i.e., biases the retainer so that pin 162 is in the lower end of the long slot or the short slot. As the flow increases through the stabilizer, the dart/flow restriction causes a pressure differential which first moves the retainer 160 downward to overcome the soft spring 168. As the retainer 160 moves downward, the locking sleeve simultaneously moves downward, and during this downward movement of the locking sleeve the bias force of the spring 156 on the locking sleeve does not increase since the axial spacing between the locking sleeve and the retainer remains substantially the same or slightly increases. The downward axial movement of the locking sleeve thus allows the pistons and locking sleeve to interlock as shown in FIG. 5. During this flow increase, the construction of the dart and the flow restriction on the retainer 160 are such that the retainer moves axially partially downward (pin 162 is in the long slot and now is positioned between the upper and lower ends of the long slot) without causing a significant change in the cross-section flow area between the dart and the restriction surface on the retainer. As the flow further increases and the differential pressure through the stabilizer increases, the biasing force of the spring 156 will actually decrease since the space between the locking sleeve and the retainer increases (once the locking sleeve is axially locked to the piston) as retainer 160 moves further down toward the bottom sub and the pin 162 moves toward the upper end of the long slot in response to increased pressure differential, until the spring 156 is completely unloaded and free, so that there will be no further spring biasing force tending to move the locking sleeve to its neutral position. Once fluid flow is increased above this rate, which is still a relatively low rate, the differential pressure through the stabilizer will prevent unlocking of the sleeve 120, since there is no biasing force tending to move the sleeve upward. As flow further increases, retainer 160 will move downward to its fullest extent (pin 162 in the top of the long slot), and the pressure differential through the tool at normal flow will not significantly increase because of the construction of the dart and the retainer 160. The stabilizer will thus be locked in the retracted position, yet the pressure drop through the stabilizer need not be excessive at normal drilling flow rates.

When the pumps are shut down, the retainer 160 rachets or indexes rotationally, so that the pin 162 is in the bottom of a short slot. At normal flow, the spring 168 keeps the retainer upward, and spring 156 keeps the locking sleeve in the run-in or disengaged position. With the pin 162 in the short slot to prevent the locking sleeve from moving appreciably downward, the spring 156 is sized so that the pressure differential across the tool moves the pistons and the corresponding blades radially outward before the pressure differential through the tool is sufficient to overcome the strong biasing force of the spring 156. To lock the stabilizer in its expanded position, flow is thus increased, but the pressure differential through the tool does not cause the retainer 160 to move downward a substantial amount since the pin is in its short slot. This increased flow does, however, sufficiently increase the pressure differential across the tool to cause the pistons to move outward to their position as shown in FIG. 6. Once the pistons have moved radially outward, increased flow will then cause the locking sleeve to move downward against the force of the spring 156, thereby locking the pistons and the stabilizer blades in the outward position as shown in FIG. 6. Downward movement of the locking sleeve also causes further downward movement of the dart with respect to the retainer 160, thereby increasing the cross-sectional flow area between the dart and the retainer 160, and thereby limiting the differential pressure through the stabilizer at normal drilling rates. The relative positions of the dart with respect to the retainer 160 will be different, however, when the stabilizer is locked in its radially inward position as compared with its radially outward position. This feature allows the drilling operator to determine the correct stabilizer mode by comparing surface pressure variations at normal flow rates due to the change in flow area through the stabilizer.

This latter-described stabilizer has advantages over the stabilizer shown in FIGS. 1–3, in that no weight-on-bit forces are required to sequence the stabilizer, and both weight-on-bit and torque may be transmitted directly through the stabilizer body without splines. The substantial advantage of the stabilizer as depicted in FIGS. 4–6 over this latter-described embodiment is that the FIGS. 4–6 stabilizer is significantly less sensitive to flow rate changes through the stabilizer and mud density variations. Since normal flow rate often vary from rig to rig, and since varying mud densities also affect the pressure differential across the nozzle, the preferred stabilizer as shown in FIGS. 4–6 may be used with different wells, while the springs in the latter-described stabilizer (without the piston 124 and with the dart) may have to be changed and "matched" to particular well operation conditions to achieve reliable stabilizer operation. Moreover, the FIGS. 4–6 embodiment does not require a sizable pressure drop through the stabilizer, which may not be available because of surface pump limitations.

Figure 8:
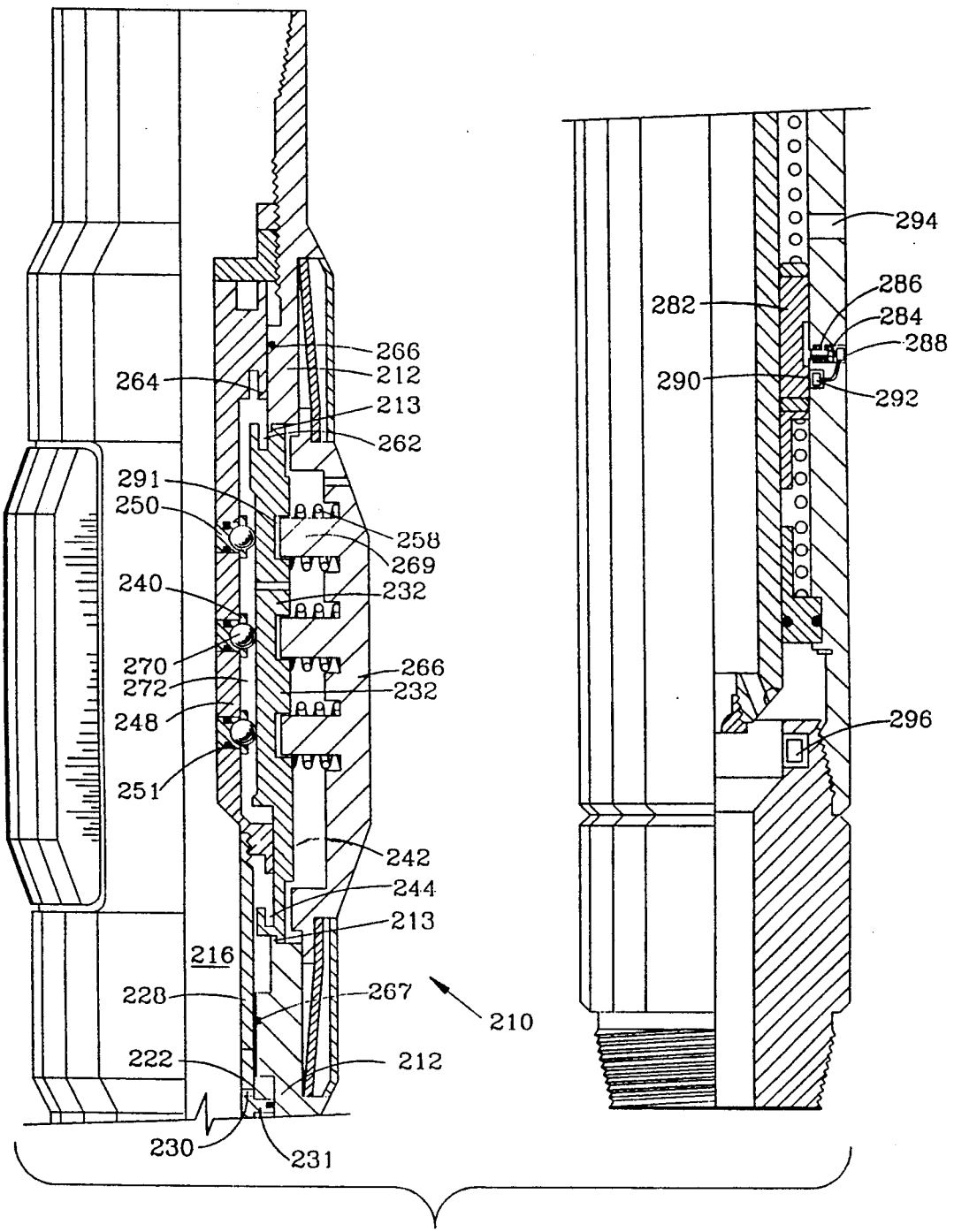
FIG. 8 is a half-sectional view of a portion of yet another embodiment of a stabilizer according to the present invention in a neutral or run-in position.

FIG. 8 depicts a portion of another embodiment of a stabilizer 210 according to the present invention. Numerous depicted components are not discussed below since they are structurally and functionally identical to components discussed above. The primary functional change from the FIGS. 4–6 embodiment to the FIG. 8 embodiment is that the pistons responsive to pressure differential to move the blades outward are positioned within a modified sliding sleeve, and a separate interlocking member is used to interconnect the sliding sleeve and to transmit the radial forces from the piston to the blades.

FIG. 8 illustrates sliding locking sleeve 248 having a plurality of pistons 250 supported thereon. Sleeve extension 228 is threadably secured to sleeve 248, and includes a port 230 and a piston 231 as discussed above. Each piston 250 is in sealed engagement with the sliding sleeve by conventional O-rings 251, and each piston includes an outer ledge 240 for limiting radial inward piston movement with respect to the sliding sleeve. Force transmitting member 232 acts to lock the stabilizer 210 in its retracted and expanded positions, as previously explained, but is not sealed to the stabilizer body 212. Rather, the modified sleeve 228 is sealed to the body 212 by seals 266 and 267 as shown in FIG. 8, and both the stabilizer blade 266 and the transmitter member 232 include flow ports so that the pressure in the interior flow path 216 of the stabilizer acts on the inner face of each piston 250, while the pressure exterior of the stabilizer acts on the outer face of each piston.

The locking sleeve 248 includes annular members 264 and 242 which interlock with annular grooves 262 and 244, respectively, in the transmitter 232, as previously explained. The upper surface 222 of the piston 231 is subject to the interior fluid pressure supplied through port 230, while the lower surface of the piston 231 is subject to annulus pressure through port 294. Extension 228 and thus the modified locking sleeve 248 must move axially to lock and unlock the stabilizer in the expanded or retracted positions, as explained above.

Each piston preferably is provided with a radially outward ball 270 to reduce frictional forces between the piston and transmitter member 232. Transmitter 232 has a plurality of recesses 291 for receiving correspondingly shaped and positioned protrusions 269 on blade 266. Coil springs 258 act to exert a radially inward biasing force to the transmitter member 232, and the biasing force of coil springs 258 is less than the biasing force of the leaf springs acting on the stabilizer blade. The balls 270 reside within a groove 272 in the transmitter member 232, and a stop 213 is provided on the body 212 for engaging and limiting radially inward movement of the curved transmitter 232. An advantage of the FIG. 8 embodiment is that the cavities which are provided in the body for receiving the stabilizer blades need not be sealing surfaces, since the radially movable pistons do not seal with the stabilizer body and are in a replaceable sleeve.

The following paragraph assumes that this stabilizer includes components below piston 231 as depicted in FIG. 4A, i.e., retainer 160 is employed. To move the blades 266 radially outward, retainer 160 is positioned with the pin in the short slot, and fluid pressure through the passageway 216 in the stabilizer is increased. This increased fluid pressure increases the differential pressure across the stabilizer which acts on the piston 231, but this differential pressure force applied to the piston 231 is initially insufficient to overcome the biasing force of the stiff spring which exerts an upward force on piston 231. The increased pressure differential through the stabilizer thus first causes the pistons 250 to move radially outward, so that the balls 270 engage the transmitter 232, and radial movement of each transmitter 232 acts on a respective blade 266 to position the blades to their outward position. The then further increase in fluid pressure will overcome the biasing force of the stiff spring, causing the locking sleeve 248 to move downward and completely radially inward of the inner surface of the transmitter member 232, so that the stabilizer becomes locked in its radially outward position. During this downward movement, the balls 270 effectively roll within the groove 272, moving downward within the groove 272 relative to the transmitter 232.

Those skilled in the art will now appreciate that the upper portion of sleeve 248 also acts as a piston to differential pressure through the stabilizer, since seal 266 has a diameter greater than seal 267. This piston effect may be used to supplement the effect of piston 231. Alternatively, piston 231 and port 230 could be eliminated and this effect replaced by the piston effect of the upper portion of sleeve 248 or, if desired, this latter piston effect may be neutralized by making seals 266 and 267 the same diameter.

The lower portion of the stabilizer 210 depicted in FIG. 8 is modified from the above description, however, in that the retainer and pin are replaced with a ring-shaped slotted spacer 282, which is keyed against rotation. A modified stop 284 is biased by spring 286 out of engagement with the elongate slot in spacer 282, so that the stiff spring is not significantly compressed, while the weak spring biases the spacer upward. With the stop 284 out of the slot in the spacer, the stabilizer behaves in the same manner as when the pin in the FIGS. 4, 4A embodiment was in the long slot. Solenoid 288 may be energized by electronics 292 (contained within cavity 290 in housing 212) at no flow through the stabilizer to move the stop 284 into the slot within the spacer, thereby limiting downward movement of the spacer, and causing the stabilizer to behave as when the pin was in the short slot in the FIGS. 4, 4A embodiment. Electronics 296, in turn, may be triggered or activated by either a downhole "smart" guidance system or surface generated communication. For each of the embodiments described above except the FIGS. 1-3 embodiment, the retainer 160 with the long and short indexing slots may thus be replaced with spacer 286 having an elongate slot therein. The solenoid 288 may be relatively small and have a nominal force output since no significant load need be overcome to move the stop 284 (which acts as a simple retractable stop) to its desired position at no fluid flow. MWD techniques can also be used to indicate the axial position of the locking sleeve or spacer 286 using, for example, magnetic pickup techniques. An exemplary sensor 296 is depicted in FIG. 8.

Various additional modifications may be made to the stabilizer of the present invention, and such modifications will be suggested by the above description. By way of example, it should be understood that for each of the embodiments depicted, a plurality of radially movable pistons may be provided for exerting a radial outward biasing force on each of the stabilizer blades. When two or more pistons are used for exerting an outward force on a transmitter, as shown in FIG. 8, which in turn press a respective stabilizer blade outward, a tie bolt may be used between each blade and a respective transmitter to maintain a desired radial spacing between each of the pistons and the transmitter to prevent the pistons from engaging the transmitter when the stabilizer is in the unlocked mode. For the embodiment wherein a plurality of pistons are provided for pressing a respective stabilizer blade outward, with each of the pistons being in sealing engagement with the stabilizer side walls, a mechanical interlock between the sliding sleeve and only one of the pistons (or optionally a top and bottom piston of the plurality of pistons) is required, and the remaining pistons may be mechanically unrestrained to move in response to pressure differential. To prohibit the remaining pistons from pressing each stabilizer blade outward in response to increased pressure differential once the locking sleeve and selected ones of the pistons are interlocked in the retracted mode, tie bolts or similar mechanical connections may be used between the interlocked piston(s) and each stabilizer blade. The interlocked piston(s) is thus prevented from moving radially outward, and the tie bolt connection between that piston and the blade prevents the blade from moving outward even though other ones of the pistons are exerting an outward force on the stabilizer blade. For this embodiment utilizing multiple pistons each in sealing engagement with a stabilizer side wall for exerting a force on each of the stabilizer blades, it should also be understood that an inner surface of only one of the pistons may engage an outer stop surface of the locking sleeve when the stabilizer is in the locked and expanded position, and this will prevent the stabilizer blade from moving inward even if the pressure differential acting on the pistons at that time is not exerting an outward force on the stabilizer blade sufficient to overcome the inward force on the blade exerted by, for example, the wall of the well bore.

As noted earlier, a radially outwardly movable piston and stabilizer blade may be integrally connected or formed as a monolithic unit, although the embodiments described herein which allow radial movement of the piston relative to the stabilizer blade is preferred. For the embodiment depicted in FIG. 8, each transmitter and stabilizer blade may optionally be made a single component. While the disclosed embodiments have illustrated three stabilizer blades each radially movable outwardly in unison, the concept of the present invention may be applied to a stabilizer with one or more stabilizer blades, and may also be applied to either concentric or eccentric stabilizers. To achieve a downhole expandable eccentric stabilizer, a single radially movable stabilizer blade responsive to radial movement of a piston or plurality of pistons may be provided. Alternatively, multiple stabilizer blades and corresponding pistons may be positioned in a nonuniform pattern about the stabilizer.

The concepts of the present invention may also be employed with various components discussed herein being housed within a relatively clean hydraulic fluid contained within a sealed and pressure-balanced system, although the axially movable pistons which exert the radial force on the stabilizer blades are still subject to the differential pressure across the stabilizer. A slight taper on the radially outward surface of interlocking member 134 (shown in FIG. 4) and a corresponding slight taper on the radially inner surface of the uppermost end and the piston 140, as well as corresponding tapers on the lower interlocking components of the sleeve and piston, may also be used to assist in pushing the piston and thus the blade radially outward. Once the interlocking mode is sequenced, the increased flow through the stabilizer will both act to move the piston outward due to increased pressure differential, and will act to move the locking sleeve downward which, due to the above-described tapers, would also force the piston outward. The feature of the tie bolts between the piston and the blade as shown in FIGS. 4–6 may be used with any of the embodiments described herein to remove the piston spring biasing force on the locking sleeve. In the FIG. 8 embodiment, the tie bolts, if used, may interconnect the members 232 and 266, so that the force of the springs 258 would not cause the transmitter 232 to forcibly engage the balls 270 at no flow, and the stops 213 could then be eliminated. Also, it should be understood that if multiple pistons are used for pressing on a stabilizer blade, a tie bolt interconnection of one piston with the blade effectively may prevent the other pistons from forcing the blade further outward.

It should be understood that the diameter variations caused by actuating a stabilizer according to the present invention may not result in significant radial movement of the blades with respect to the stabilizer body. A typical stabilizer according to the present invention may, for example, have a minimal diameter of 11-¾ inches when locked in its minimum position, and a maximum diameter of 12-¼ inches when in its locked and expanded position. This relatively small change in stabilizer diameter is sufficient, however, to achieve the significant purpose of a variable diameter stabilizer according to the present invention.

The differential pressure across the stabilizer, when combined with the significant space area of the pistons acting on the blades, is sufficient to generate a sizable radially outward force to move the stabilizer blades outward. From the above description, it should also be understood to those skilled in the art how the tool may be modified so that the stabilizer may be sequenced and locked in any one of three different radial positions. In this case, the stabilizer as shown in FIGS. 4–6 preferably will have three sets of springs, two retainers, and two different sets of slots in the piston, thereby causing the piston and sleeve to become locked in either the fully retracted, intermediate, or maximum diameter position.

The techniques of the present invention may also be used on downhole equipment other than stabilizers. The sequencing techniques may, however, for example, be used on downhole tools including packers, under-reamers, fishing tools, and sampling tools, wherein it is desired to change the radial position of a downhole component from the surface.

The embodiments of the invention described above and the methods disclosed herein will suggest numerous modifications and alterations to those skilled in the art from the foregoing disclosure. Such further modifications and alterations may be made without departing from the spirit and scope of the invention, which should be understood to be defined by the scope of the following claims in view of this disclosure.

What is claimed is:

1. A downhole adjustable stabilizer for use in a well bore and along a drill string having a bit at the lower end thereof, the drill string having an interior flow path for passing pressurized fluid through the stabilizer and to the bit, the stabilizer comprising:

a stabilizer body having an interior passage for fluid communication with the drill string interior flow path, the stabilizer body including an upper end for interconnection with an upper portion of the drill string, a lower end for interconnection to a lower portion of the drill string between the stabilizer and the bit, and an intermediate portion including one or more cavities spaced about the stabilizer body, each cavity defined at least in part by stabilizer body sidewalls;

one or more stabilizer blades each received within a respective cavity in the stabilizer body, each stabilizer blade being radially movable with respect to the stabilizer body from a retracted position to an expanded position;

one or more radially movable pistons each positioned inwardly of a corresponding one of the one or more stabilizer blades, each piston being radially movable from an inward position to an outward position in response to pressure differential between the interior flow path within the stabilizer body and the well bore exterior of the stabilizer, the radial movement of the one or more pistons functionally controlling the radial movement of the corresponding stabilizer blade; and a locking member carrying the one or more radially movable pistons, the locking member being in sealed engagement with the stabilizer body, and the one or more radially movable pistons being in sealed engagement with the locking member, the locking member being axially movable within the stabilizer body from an unlocked position to a locked and retracted position for limiting the radial outward movement of at least one of the one or more pistons when in the locked and retracted position, thereby maintaining the corresponding stabilizer blade in its retracted position.

2. The downhole adjustable stabilizer as defined in claim 1, further comprising:

the locking member is an axially movable locking sleeve including at least one sleeve interlocking member; and a radially movable force transmitter positioned radially between the one or more pistons and the corresponding stabilizer blade for transmitting a radial outward force from the one or more pistons to the corresponding stabilizer blade, the force transmitter including at least one transmitter interlocking member for engagement with the sleeve interlocking member to limit radial outward movement of the transmitter with respect to the locking sleeve.

3. The downhole adjustable stabilizer as defined in claim 2, further comprising:

the locking sleeve has a central flow path for transmitting pressurized fluid through the stabilizer and includes a stop surface for engaging a radially inner surface of the transmitter, the locking sleeve being axially movable to a locked and expanded position such that the locking sleeve stop surface engages the inner surface of the transmitter to prevent radially inward movement of the transmitter and thereby lock the corresponding stabilizer blade in its expanded position.

4. The downhole adjustable stabilizer as defined in claim 2, further comprising:

a locking biasing member for biasing the locking sleeve to disengage the sleeve interlocking member and the transmitter interlocking member, such that the one or more pistons move radially in response to the pressure differential between the interior flow path within the stabilizer body and the well bore exterior of the stabilizer when the locking member is in the unlocked position.

5. The downhole adjustable stabilizer as defined in claim 2, further comprising:

the force transmitter is radially movable with respect to the corresponding stabilizer blade, such that the one or more pistons may move the force transmitter radially outward in response to the pressure differential without moving the corresponding stabilizer blade; and one or more transmitter biasing members for biasing the force transmitter to a radially inward position with respect to the corresponding stabilizer blade.

6. The downhole adjustable stabilizer as defined in claim 2, further comprising:

stop means fixedly secured to the stabilizer body for limiting radial inward movement of the force transmitter and maintaining a radial spacing between the one or more pistons and the force transmitter to selectively prevent the one or more pistons from engaging the force transmitter.

7. The downhole adjustable stabilizer as defined in claim 2, wherein at least one of the one or more pistons includes a roller member for rolling engagement with the force transmitter when the locking sleeve moves axially with respect to the force transmitter.

8. A downhole adjustable stabilizer for use in a well bore and along a drill string having a bit at the lower end thereof, the drill string having an interior flow path for passing pressurized fluid through the stabilizer, the stabilizer comprising:

a stabilizer body having an interior passage for fluid communication with the drill string interior flow path, the stabilizer body including an upper end for interconnection with an upper portion of the drill string, a lower end for interconnection to a lower portion of the drill string, and an intermediate portion including a plurality of cavities circumferentially spaced about the stabilizer body, each cavity defined at least in part by stabilizer body sidewalls;

a plurality of stabilizer blades each received within a respective cavity in the stabilizer body, each stabilizer blade being radially movable with respect to the stabilizer body from a retracted position to an expanded position;

a plurality of radially movable pistons each positioned inwardly of a corresponding stabilizer blade, each piston being radially movable from an inward position to an outward position in response to pressure differential between the interior flow path within the stabilizer body and the well bore exterior of the stabilizer, the radial movement of each of the plurality of pistons mechanically effecting the radial movement of the corresponding stabilizer blade; and a locking sleeve axially movable within the stabilizer body from an unlocked position to a locked and retracted position, the locking sleeve having a central flow path for transmitting pressurized fluid through the stabilizer body, the locking sleeve being in sealed engagement with the stabilizer body, each of the plurality of radially movable pistons being carried on the locking sleeve and being in sealed engagement with the locking sleeve, the axial movement of the locking sleeve to its locked and retracted position limiting the radial outward movement of at least one of the plurality of pistons, thereby maintaining the corresponding stabilizer blade in its retracted position.

9. The downhole adjustable stabilizer as defined in claim 8, further comprising:

the locking sleeve having one or more sleeve interlocking members; and a radially movable force transmitter positioned radially between a respective one of the plurality of pistons and the corresponding stabilizer blade for transmitting a radial outward force from the respective one of the plurality of pistons to the corresponding stabilizer blade, the force transmitter including at least one transmitter interlocking member for engagement with the sleeve interlocking member to limit radial outward movement of the transmitter with respect to the locking sleeve.

10. The downhole adjustable stabilizer as defined in claim 9, further comprising:

the locking sleeve including a stop surface for engaging a radially inner surface of the transmitter, the locking sleeve being axially movable to a locked and expanded axial position such that the locking sleeve stop surface engages the inner surface of the transmitter to prevent radially inward movement of the transmitter and thereby lock the corresponding stabilizer blade in its expanded position.

11. The downhole adjustable stabilizer as defined in claim 9, further comprising:

a locking biasing member for biasing the locking sleeve to disengage the sleeve interlocking member and the transmitter interlocking member, such that the plurality of pistons move radially in response to the pressure differential between the interior flow path within the stabilizer body and the well bore exterior of the stabilizer when the locking sleeve is in the unlocked position.

12. The downhole adjustable stabilizer as defined in claim 9, further comprising:

the force transmitter being radially movable with respect to the corresponding stabilizer blade, such that the respective piston may move the force transmitter radially outward in response to the pressure differential without moving the corresponding stabilizer blade; and one or more transmitter biasing members for biasing the force transmitter to a radially inward position with respect to the corresponding stabilizer blade.

13. The downhole adjustable stabilizer as defined in claim 9, further comprising:

stop means fixedly secured to the stabilizer body for limiting radial inward movement of the force transmitter and selectively maintaining a radial spacing between the respective piston and the force transmitter.

14. The downhole adjustable stabilizer as defined in claim 9, wherein at least one of the plurality of pistons includes a roller member for rolling engagement with the force transmitter when the locking sleeve moves axially with respect to the force transmitter.

15. A downhole adjustable stabilizer for use in a well bore and along a drill string having a bit at the lower end thereof, the drill string having an interior flow path for passing pressurized fluid through the stabilizer and to the bit, the stabilizer comprising:

a stabilizer body having an interior passage for fluid communication with the drill string interior flow path, the stabilizer body including an upper end for interconnection with an upper portion of the drill string, a lower end for interconnection to a lower portion of the drill string between the stabilizer and the bit, and an intermediate portion including one or more cavities spaced about the stabilizer body, each cavity defined at least in part by stabilizer body sidewalls;

one or more stabilizer blades each received within a respective cavity in the stabilizer body, each stabilizer blade being radially movable with respect to the stabilizer body from a retracted position to an expanded position;

one or more radially movable pistons each positioned inwardly of a corresponding one of the one or more stabilizer blades, each piston being radially movable from an inward position to an outward position in response to pressure differential between the interior flow path within the stabilizer body and the well bore exterior of the stabilizer, the radial movement of the one or more pistons functionally controlling the radial movement of the corresponding stabilizer blade;

a locking sleeve including at least one sleeve interlocking member and movable within the stabilizer body from an unlocked position to a locked and retracted position and from its unlocked position to a locked and expanded position, the locking member being in sealed engagement with the stabilizer body, and the one or more radially movable pistons being in sealed engagement with the locking sleeve;

one or more radially movable force transmitters each positioned radially between the one or more pistons and the corresponding stabilizer blade for transmitting a radial outward force from the one or more pistons to the corresponding stabilizer blade, each force transmitter including at least one transmitter interlocking member for engagement with the sleeve interlocking member;

the transmitter interlocking member and the sleeve interlocking member engaging to mechanically prevent radially outward movement of the corresponding force transmitter when the locking sleeve is in its locked and retracted position; and the transmitter interlocking member and the sleeve interlocking member engaging to mechanically prevent radially inward movement of the corresponding force transmitter when the locking sleeve is in its locked and expanded position.

16. The downhole adjustable stabilizer as defined in claim 15, wherein the sleeve locked and retracted axial position with respect to the stabilizer body is different than the sleeve locked and expanded axial position with respect to the stabilizer body.

17. The downhole adjustable stabilizer as defined in claim 15, further comprising:

a locking biasing member for biasing the locking sleeve to disengage the sleeve interlocking member and the transmitter interlocking member, such that the one or more pistons move radially in response to the pressure differential between the interior flow path within the stabilizer body and the well bore exterior of the stabilizer when the locking member is in the unlocked position.

18. The downhole adjustable stabilizer as defined in claim 15, further comprising:

the force transmitter is radially movable with respect to the corresponding stabilizer blade, such that the one or more pistons may move the force transmitter radially outward in response to the pressure differential without moving the corresponding stabilizer blade; and one or more transmitter biasing members for biasing the force transmitter to a radially inward position with respect to the corresponding stabilizer blade.

19. The downhole adjustable stabilizer as defined in claim 15, further comprising:

stop means fixedly secured to the stabilizer body for limiting radial inward movement of the force transmitter and maintaining a radial spacing between the one or more pistons and the force transmitter to selectively prevent the one or more pistons from engaging the force transmitter.

20. The downhole adjustable stabilizer as defined in claim 15, wherein each of the one or more pistons includes a roller member for rolling engagement with the force transmitter when the locking sleeve moves axially with respect to the force transmitter.

* * * * *